United States Patent [19]

Lapeyre

[11] 4,203,302

[45] May 20, 1980

[54] FLOOR MOUNTED AIR CONDITIONER

[75] Inventor: James M. Lapeyre, New Orleans, La.

[73] Assignee: The Laitram Corporation, New Orleans, La.

[21] Appl. No.: 924,823

[22] Filed: Jul. 14, 1978

[51] Int. Cl.[2] ..... F25D 23/12; F25B 47/00; F25D 21/14

[52] U.S. Cl. ..... 62/259; 62/263; 62/279; 62/285; 62/305; 62/315; 62/DIG. 16

[58] Field of Search ..... 62/259 C, 259 R, 285 X, 62/263 X, 305 X, DIG. 16, 279, 315

[56] References Cited

U.S. PATENT DOCUMENTS

| | | | |
|---|---|---|---|
| 2,234,753 | 3/1941 | Frazer | 62/279 X |
| 2,747,383 | 5/1956 | Schlumbohm | 62/279 X |
| 2,766,597 | 10/1956 | Gieck | 62/315 X |
| 3,267,995 | 8/1966 | Maudlin | 62/259 R |

*Primary Examiner*—Lloyd L. King
*Attorney, Agent, or Firm*—Weingarten, Maxham & Schurgin

[57] ABSTRACT

A floor mounted air conditioner comprising a housing containing cylindrical condenser coils disposed about a normally vertical axis and cylindrical evaporator coils coaxially disposed above the condenser coils. A drip pan separates the condenser and evaporator coils and includes openings for discharging condensate onto the condenser coils for evaporation. A condenser fan is associated with a bottom duct adapted for installation in a mounting opening in the floor of a room, for blowing hot air through the mounting opening, and an evaporator fan is associated with a top duct for blowing cool air into the room being cooled.

6 Claims, 3 Drawing Figures

FLOOR MOUNTED AIR CONDITIONER

FIELD OF THE INVENTION

This invention relates to air conditioners and more particularly to an air conditioner especially adapted for mounting in an opening of a floor.

BACKGROUND OF THE INVENTION

Air conditioners are very well known and are constructed in many different forms to suit the particular cooling requirements of a facility. In a typical self-contained air conditioning unit such as employed to cool one or more rooms of a building, a refrigeration system containing a compressor and associated cooling and evaporator coils and blowers is contained within a suitable housing which is usually constructed for mounting in a window or wall opening of a building. It would be desirable to provide an air conditioner which can be installed such as to not mar the appearance of a building by the unsightly protrusion of air conditioning units from the walls or windows thereof and to provide an air conditioner which is adapted for more efficient mounting and operation.

SUMMARY OF THE INVENTION

In brief, the present invention provides an air conditioner especially adapted to mounting in an opening of a floor of a room or other facility. The novel air conditioner comprises a generally cylindrical housing having a bottom duct adapted for installation in a mounting opening in the floor and a top duct from which cooled air can be emitted into a room. Within the housing is contained a compressor and associated condenser and evaporator coils and blowers. The condenser coils are cylindrical and are disposed about a vertical axis, while the evaporator coils are of cylindrical configuration disposed about the same vertical axis above the condenser coils. A drip pan separates the condenser and evaporator coils and includes openings through which condensate can be discharged by gravity feed onto the condenser coils for evaporation. A condenser fan is associated with the bottom duct for blowing hot air through the mounting opening away from the room being cooled. An evaporator fan is associated with the upper duct for blowing cool air into the room.

The invention is especially useful in buildings which are raised off of the ground, and in buildings having interior rooms with no windows. The novel air conditioner can be readily installed in a mounting opening in the floor with the same ease as a window mounted unit but without the disadvantages of a window mounting. Floor mounting is especially advantageous as the floor in a building is usually a much better structural support than a wall, and thus the present floor mounted air conditioner will exhibit less vibration and noise than a conventional window mounted unit.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
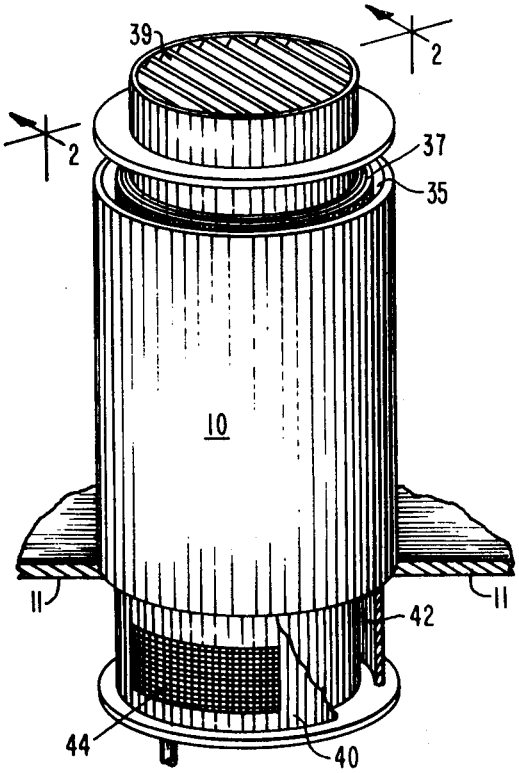
FIG. 1 is a pictorial view of a floor mounted air conditioner according to the invention.
Figure 2:
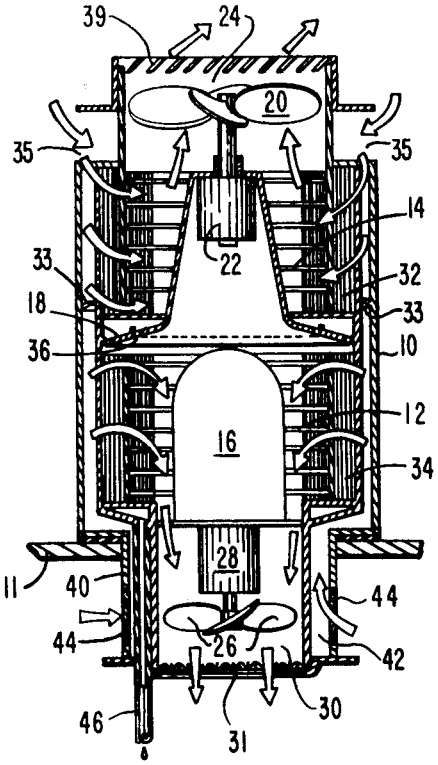
FIG. 2 is a sectional elevation view of the air conditioner of FIG. 1.

Referring to FIG. 1 and 2 of the drawing, there is shown an air conditioner comprising a housing 10 having disposed therein cylindrical condenser coils 12 disposed about a vertical axis, and cylindrical evaporation coils 14 disposed about the same vertical axis and coaxially above the condenser coils. The coils 12 and 14 are in connection with a compressor 16 in a usual refrigeration loop. A drip pan 18 is disposed within the housing and separates the condenser coils and the evaporator coils. A fan 20 is disposed at the top of the housing and is driven by an associated motor 22 for blowing cooled air out of the discharge duct 24. A second fan 26 and associated motor 28 is disposed at the bottom of the housing and is operative to blow heated air out of the bottom duct 30 through a screen 31. A cylindrical filter is provided around the evaporator coils 14 and cylindrical wick 34 is provided around the condenser coils 12. This wick is of loose woven material to not unduly restrict air flow and to absorb condensate directed onto the wick from one or more openings 36 in the drip pan 18 during operation of the air conditioner. An air inlet 35 is provided at the top of housing 10 and usually includes an air filter 37. The cooled air port of duct 24 can include a set of deflectors 29 for directing the air flow into the room.

The housing 10 is adapted for mounting of the air conditioner unit through an opening in the floor 11 of a room or other area to be cooled. As illustrated, the lower portion of the housing includes a circular wall 40 which can be inserted into a mounting opening in the floor. The wall 40 is spaced from the hot air exhaust duct 30 and provides a surrounding annular duct 42 having inlet openings 44 through wall 40 into which air is drawn. Air drawn into the annular duct 42 from the space below the floor passes up through the housing and over the evaporator coils 14 for cooling, the cooled air then being blown by the cooling fan 20 out of the cool air duct 24. Air drawn in from the annular duct 42 also passes through the wick 34 and over the condenser coils 12 to aid in cooling of the coils. Heated air from the condenser cools is exhausted down through the lower duct 30 by means of exhaust fan 26. Condensation from the evaporation coils 14 drips into the drip pan 18 where the condensate is discharged onto the wick 34 for uniform distribution of the condensate around the condenser coils to aid in cooling of these coils. Excess condensate is discharged from the bottom of the unit below the floor via pipe 46. Air flow can be adjusted by a damper 33 provided in housing 10 to vary the relative amounts of air being drawn in from the room via inlet 35, and being drawn in from inlets 44 below the floor.

The floor mounted air conditioner described above has major benefits in comparison with air conditioning units of conventional construction. Cooler air can be drawn from under the floor, such as in a basement area, for greater efficiency in comparison to air drawn in by a window mounted unit. In addition, the air conditioning unit, by reason of its internal floor mounting, is not exposed to sun, rain and other environmental conditions which adversely affect the efficiency and durability of conventional units. By reason of its internal floor mounted configuration, there is no protrusion from the window or wall to mar the appearance of a building or to drip condensate from the side of a building. Nor are brackets or elaborate mounting arrangements needed; the novel unit is simply "plugged in" to the floor mounting opening. Moreover, the air conditioner is not in an external position subject to accidental or intentional damage.

Figure 3:
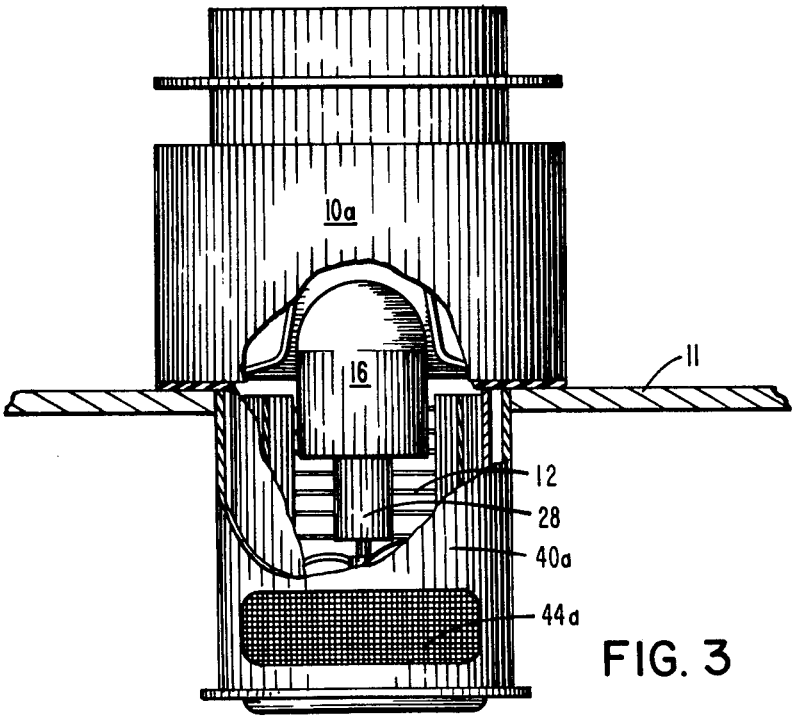
FIG. 3 is a sectional elevation view of an alternative embodiment of the novel air conditioner.

An alternative embodiment is shown in FIG. 3 wherein the housing 10*a* is of lower profile and contains the cylindrical evaporation coils and associated cold air blower therein as in the embodiment described above. The lower portion 40*a* of the housing disposed beneath the floor 11 includes the compressor 16, fan 28 and condenser coils 12. The compressor and hotter coil of the air conditioner are disposed below the floor in the embodiment of FIG. 3 to further reduce the noise and heat in the room in which the unit is mounted.

The invention is not to be limited except as indicated in the appended claims.

What is claimed is:

1. A floor mounted air conditioner comprising:

a housing having a lower portion and an upper portion, the lower portion of the housing including a cylindrical wall insertable into a mounting opening in the floor of a room to be cooled, the upper portion of the housing being disposable above the floor and having a cold air exhaust duct upwardly extending from the upper portion and terminating in an upper cold air exhaust port;

an annular inlet at the top of the upper portion of said housing for drawing air from the room into the housing for cooling, said annular inlet surrounding and spaced from said upper cold air exhaust port;

a hot air exhaust duct in the lower portion of said housing terminating in a lower hot air exhaust port at the bottom end of the lower housing portion below the mounting floor;

an annular duct in the lower housing portion defined by the wall of the lower housing portion and the hot air exhaust duct and having inlet openings in the wall of the lower housing portion into which air is drawn from below the floor into the housing for cooling;

a compressor within the housing;

cylindrical condenser coils disposed about a vertical axis in the housing;

cylindrical evaporator coils disposed about said vertical axis in said housing and above said condenser coils;

a drip pan in said housing separating said condenser and evaporator coils and including one or more openings arranged to discharge condensate onto said condenser coils;

a condenser fan in said hot air exhaust duct for blowing hot air from said housing out of said lower hot air exhaust port into the space below the floor;

an evaporator fan disposed in the upper cold air exhaust duct for blowing cooled air out of said upper cold air exhaust port into the room; and an annular duct in the upper housing portion in communication with the annular duct in the lower housing portion for directing air from the annular inlet over the evaporator coils and air from the inlet openings in the wall of the lower housing portion over the evaporator coils.

2. The floor mounted air conditioner of claim 1 wherein said annular ducts are operative to direct air from the inlet openings below the mounting floor over the condenser coils to aid in the cooling thereof.

3. The floor mounted air conditioner of claim 1 wherein said compressor, condenser coils and condenser fan are disposed below the mounting floor in the lower portion of said housing to reduce the noise and heat of the compressor condenser coils and condenser fan in the room in which the air conditioner is mounted.

4. The floor mounted air conditioner of claims 1 further including a loose weave wick disposed around said condenser coils in a position to receive condensate from the openings in said drip pan for uniform distribution of condensate around said condenser coils to aid in the cooling thereof.

5. The floor mounted air conditioner of claim 1 including a damper in the annular duct of said upper housing portion and operative to vary the relative amount of air drawn in to said housing via said annular inlet and said inlet openings.

6. The floor mounted air conditioner of claim 5 including a drain pipe downwardly disposed from said housing and operative to discharge condensate collected from said evaporator coils.

* * * * *